US008485206B1

(12) United States Patent
Rose

(10) Patent No.: US 8,485,206 B1
(45) Date of Patent: Jul. 16, 2013

(54) COLLAPSIBLE BUOYANT SUN SHADE

(76) Inventor: Janice Elaine Rose, The Colony, TX (US)

( * ) Notice: Subject to any disclaimer, the term of this patent is extended or adjusted under 35 U.S.C. 154(b) by 150 days.

(21) Appl. No.: 12/932,591

(22) Filed: Mar. 1, 2011

(51) Int. Cl.
*A45B 23/00* (2006.01)

(52) U.S. Cl.
USPC ..... 135/16; 135/98; 135/20.2; 135/33.4; 441/129; 441/136; 446/221

(58) Field of Classification Search
USPC ..... 135/15.1, 16, 20.2, 33.2–33.41, 98, 135/119; 441/129–134, 136, 38, 44; 472/128–129; 405/186–187; 4/498–499; 5/420, 5/424; 446/127, 220–221, 227
See application file for complete search history.

(56) References Cited

U.S. PATENT DOCUMENTS 3,602,930 A * 9/1971 Channon ..... 441/65
4,100,633 A 7/1978 Pintos
4,768,317 A * 9/1988 Markham ..... 52/74
4,790,340 A 12/1988 Mahoney
5,088,723 A * 2/1992 Simmons ..... 472/129
5,090,435 A * 2/1992 Leclercq ..... 135/98
5,299,588 A 4/1994 MacLeod
5,347,667 A * 9/1994 Schwarz et al. ..... 5/418
5,394,822 A 3/1995 Worland
5,458,517 A 10/1995 Ellis
5,505,645 A * 4/1996 Engler, Jr. ..... 441/1
5,528,849 A * 6/1996 Plinta ..... 43/1
5,690,133 A 11/1997 Capwell
5,885,123 A * 3/1999 Clifford ..... 441/129
6,062,243 A * 5/2000 Tuch et al. ..... 135/124
6,209,150 B1 4/2001 Hsu
6,749,474 B2 6/2004 Hsu
7,357,688 B2 4/2008 Ferrara
7,431,388 B2 10/2008 Sharapov
7,779,849 B2 8/2010 Labarbera
7,793,674 B2 9/2010 Elder
8,042,561 B2 * 10/2011 Moravec Varga et al. ..... 135/16
2003/0046755 A1 * 3/2003 Hingle ..... 4/498
2003/0220032 A1 11/2003 Hsu

* cited by examiner

*Primary Examiner* — Winnie Yip
(74) *Attorney, Agent, or Firm* — John Lindsay

(57) ABSTRACT

A sun shade designed for portability and selective angular orientation in a body of water. The device comprises an umbrella portion, together with at least two distally joined buoyant members to keep the umbrella from sinking. The umbrella portion's cover comprises generally opaque material to keep the sun's rays from penetrating. The user orients the expanded umbrella towards the sun and allows the umbrella to float on the buoyant members while the user is below the umbrella. The shape and selective angular orientation of the sun shade enable the user to block rays of the sun from 0° to 90° relative to the surface of the water.

14 Claims, 1 Drawing Sheet

COLLAPSIBLE BUOYANT SUN SHADE

BACKGROUND

1. Field of the Invention

The present invention relates to portable devices to provide shade from the sun. More specifically, a sun shade which is buoyant and can provide shade to users while in a swimming pool or other body of water. The shade is based upon a structure similar to an umbrella which is of common known in the art. The fabric cover for said umbrella is opaque so as to prevent the penetration of the rays of the sun. The frame of the umbrella is equipped with flotation devices which function to keep the structure afloat. The sun shade is oriented so the flotation devices are oriented toward the sun to protect the user from the sun's harmful rays. The shade is collapsible and can be placed in a carry bag for easy transport.

2. Description of the Prior Art

The prior art generally is directed to various structures, such as chairs, small swimming pools to which various attachments to umbrellas to provide shade from the sun. Generally the devices which are in the nature of a covered or shaded swimming pool have the covers clamped or otherwise attached to the side of said swimming pool. Additional prior art discloses a buoyant frame attached to a rigid support over which shade material is stretched. Another structure comprises a folding chair with an elongated back from which shade material is suspended, said shade material being attached by cord or string to the forward end of extensions incorporated in the arms of said chair thereby forming a space under said shade material for the occupant.

Additional prior art discloses an umbrella from which shade material generally of a design similar to a window shade is suspended and wherein said suspended shade material is oriented towards the sun.

SUMMARY OF THE INVENTION

The invention provides a collapsible sun shade in the general form of an umbrella, which is commonly known in the art. The material stretched over the umbrella frame is generally opaque so as to provide shade from the sun.

Attached to a portion of the circumference of the umbrella are buoyant devices. In the preferred embodiment, the flotation device is elongated, extruded foam plastic, such as styrofoam, which is generally of a circular cross section. These elongated plastic items are generally sold as floatation aids and commonly referred to as "noodles". Two pieces of noodles are employed, one longer than the other. The longer noodle is affixed to a portion of the outer circumference of the umbrella by first piercing the foam plastic with the ends of the ribs of the umbrella frame. The noodle is affixed to said umbrella by flexible strips of material, fixedly attached to the fabric of said umbrella at one end and removably attached to said fabric at the other end by the use of material such as Velcro®. A second shorter "noodle" with a central cavity longitudinally therethrough is affixed to the handle of said umbrella to maintain an angular flotation attitude.

BRIEF DESCRIPTION OF THE DRAWINGS

A further understanding of the present invention will become apparent upon consideration of the following detailed description taken in connection with the accompanying drawings, wherein.

DETAILED DESCRIPTION OF THE PREFERRED EMBODIMENT

Figure 1:
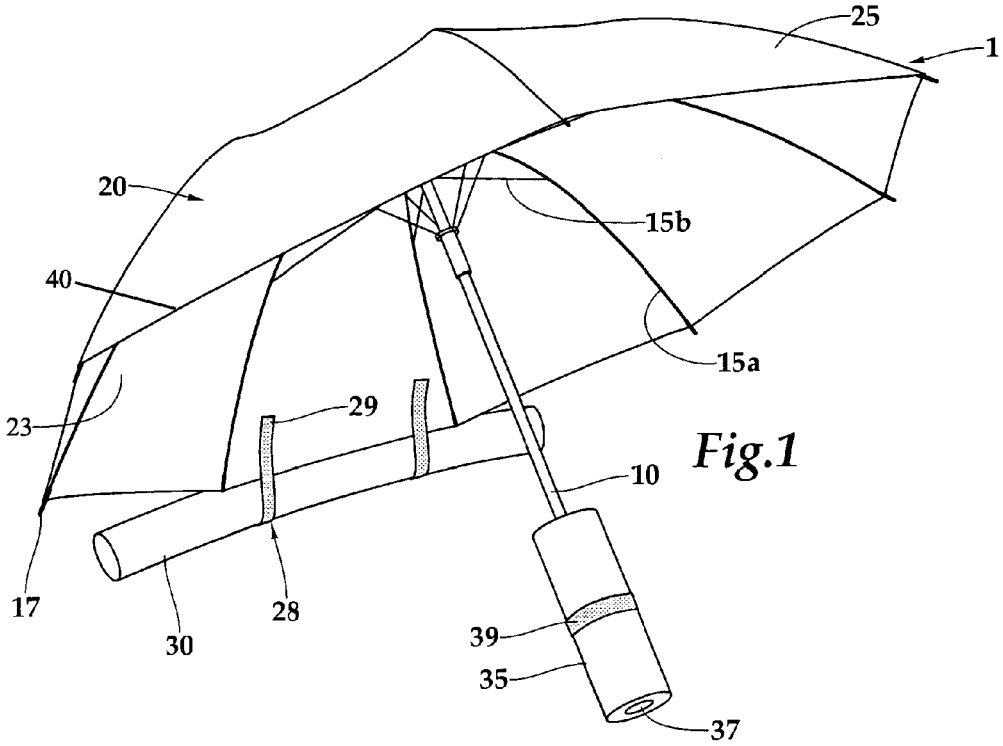
FIG. 1 is a perspective view of the present invention with the umbrella portion extended and the floatation devices attached.

A first embodiment of the present invention shall be discussed with reference to FIG. 1 and FIG. 2, which illustrates a perspective view of the invention.

The umbrella portion of the invention, 1, comprises a central support member, 10, having a first, or top, end, and a second, or bottom, end. A plurality of primary support members, extend radially from the top end of the central support member 10. Optionally, secondary support members 15*b* are attached to both the primary support members 15*a* and the central support member 10, providing support to the primary support members 15*a*. A first end of the secondary support member 15*b* is attached to the primary support member 15*a*. A second end of the secondary support members 15*b* is attached to the central support member 10, preferably slidably attached, enabling radial expansion and collapsing of pivotably attached primary support members 15*a*. A circular opaque covering, 20, having an inside surface, 23, and an outside surface, 25 and dimensioned to span the radial area of the primary support members, 15*a*, is fixedly attached to the primary support members 15*a*. The outer edge 40 of the cover 20 presents a perimeter.

The floatation portion of said invention comprises at least two buoyant members 30, 35, operable to float the device 1 on the surface of a body of water. In the preferred embodiment, the buoyant members 30, 35 are composed of buoyant foam plastic, such as Styrofoam®, but other buoyant materials are in the spirit of this invention. The preferred buoyant members 30, 35 are shaped with a generally circular cross-section and present a longitudinal axis therethrough. The preferred buoyant members 30, 35 comprise what are known as "noodles" in the flotation art. In an alternate configuration, the buoyant member 30 or 35 can comprise an inflatable plastic bladder.

The first buoyant member 30 is fixed, preferably removably, to the edge 40 of the cover 20 using a fastener. In a first configuration, the fastener comprises an end 17 extending from the primary support member 15*a*, where the end 17 extends slightly beyond the cover 20. One or more ends 17 is inserted or "poked" into the first buoyant member 30. In an alternate configuration, the fastener comprises one or more longitudinal attachment strips 28 secured to opposing surfaces 23 25 of the cover 20 by means in the art such as hook and loop, gluing, or sewing. The longitudinal attachment strips 28 have a first end attached to the outside surface 25 of the cover 20. A second end 29 is attached, preferably removably, to the inside surface 23 of the cover 20. The attachment strip 28 defines a perimeter through which the first buoyant member 30 can be introduced.

The second buoyant member 35 is joined, preferably removably, to the bottom end of the central support member 10 using a coupling. The second buoyant member 35 is preferably substantially shorter than the first buoyant member 30. The preferred coupling comprises a bore 37, approximately the diameter of the central support member 10, through the longitudinal axis of the second buoyant member 35. The coupling may further comprise a connection strip 39, a flexible strip of material for tightly wrapped around the second buoyant member, 35, in order to further prevent unwanted longitudinal movement along the central support member, 10.

In preparation for use, said ends, 17, are inserted into said first buoyant member, 30, at several points along the edge 40 of the cover 20. The first ends of the attachment strips, 28 are attached to the outside surface 25 of said opaque cover, 20. The second ends, 29, of the attachment strips, 28 are attached to the inside surface, 23, of said opaque covering, 20. The second buoyant member 30 is attached to the bottom end of the central support member 10. The sun shade 01 is placed on the body of water with the outer surface 25 of the cover 20 facing the sun.

Figure 2:
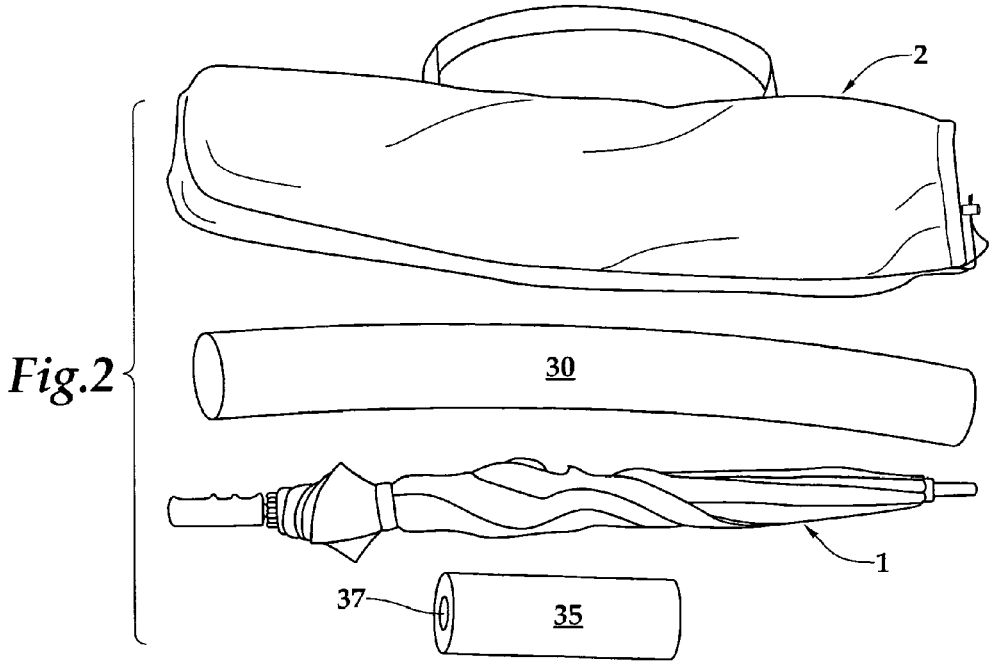
FIG. 2 is a perspective view of the present invention in collapsed form together with a carry bag for storage of said invention.

FIG. 2, depicts the umbrella, 1, in a folded condition with said buoyant members, 30, 35, removed and a carrying case, 2, therefor.

The invention has been described with reference to certain preferred embodiments thereof. It will be understood, however, that modifications and variations are possible within the scope of the appended claims. The invention is not limited to the specific mechanical structures illustrated in the preferred embodiments for folding sun shades, but instead, is intended to cover any buoyant, foldable umbrella used as a sun shade.

I claim:

1. A collapsible, buoyant sun shade comprising:

a central support member having a top and a bottom end;

a plurality of primary support members pivotably attached to and radially extending from said top end of said central support member;

an opaque covering attached to said primary support members, said covering spanning radial area of said primary support members, said covering presenting an edge defining a perimeter;

a first buoyant member attached to said perimeter of said covering with a fastener; and a second buoyant member having a center bore providing a coupling to attach the second buoyant member to the bottom end of the central support; and wherein the first and second buoyant members operable for angularly floating the sun shade on a water surface.

2. The sun shade of claim 1, wherein said first and second buoyant members are removably attached to said sun shade.

3. The sun shade of claim 1, wherein said first and second buoyant members comprise buoyant semi-rigid material.

4. The sun shade of claim 1, wherein said first and second buoyant members comprise elongated low density, foamed plastic having a circular cross-section.

5. The sun shade of claim 1, wherein said first and second buoyant members comprise inflatable bladders.

6. The sun shade of claim 1, wherein said first buoyant member is fixedly attached to said opaque covering.

7. The sun shade of claim 1, wherein said second buoyant member is fixedly attached to said bottom end of said central support member.

8. The sun shade of claim 1, wherein said fastener comprises an end extending from said primary support member, whereby said end is inserted into said first buoyant member.

9. The sun shade of claim 1, wherein said fastener comprises an attachment strip secured to the surfaces of said cover, presenting a perimeter whereby said first buoyant member may secured therein.

10. The sun shade of claim 9, wherein said attachment strip is secured with hook and loop material.

11. The sun shade of claim 1, wherein said center bore extending through the longitudinal axis of said second buoyant member, whereby said bottom end of said central support member is inserted.

12. A collapsible buoyant sun shade comprising:

an umbrella portion comprising a central support member and support members:

said central support member having a first, upper end, and a second, lower end;

said support members including primary support members extending distally from said upper end of said central support member, said primary support members having a first, inner, end being movably attached to said upper end of said central support member, and a second, outer, end of primary support members operable to radially collapse and expand from close proximity to said central support member, to a distal position therefrom;

an opaque covering extending over primary support member, said opaque covering having an outer edge;

a first, buoyant, semi-rigid, detachable member composed of piercable material, whereby said second, outer end of said primary support member selectively piercing, attaching and positioning, said first buoyant, detachable member along said edge of said opaque cover, and said first, buoyant, semi-rigid, detachable member being secured to the outer edge of the opaque covering by fasteners;

a second, buoyant, semi-rigid, detachable member having a hollow center fixedly receiving said lower end of said central support member; wherein the first and second buoyant, semi-rigid, detachable members operable for angularly floating the sun shade on a water surface; and a carrying container capable of holding said umbrella portion in a collapsed position and said first and second buoyant, semi-rigid, detachable members, said buoyant detachable members having first been removed from said umbrella portion.

13. The sun shade of claim 12, wherein said first and second buoyant, semi-rigid, detachable members are composed of foamed, plastic material.

14. The sun shade of claim 12, wherein said buoyant, semi-rigid detachable members are of unequal length with respect to each other.

* * * * *